United States Patent [19]

Modugno et al.

[11] Patent Number: 4,635,916

[45] Date of Patent: Jan. 13, 1987

[54] DUAL-MODE COPIER DOCUMENT FEEDER AND COMPUTER FORMS WEB RESTACKER

[75] Inventors: Joseph J. Modugno; William R. Klimley, both of Rochester, N.Y.

[73] Assignee: Xerox Corporation, Stamford, Conn.

[21] Appl. No.: 787,569

[22] Filed: Oct. 15, 1985

[51] Int. Cl.[4] ..... B65H 1/00

[52] U.S. Cl. ..... 271/3; 226/199; 271/171; 271/224

[58] Field of Search ..... 271/3, 3.1, 171, 223, 271/224; 226/199

[56] References Cited

U.S. PATENT DOCUMENTS

| | | | |
|---|---|---|---|
| 3,700,231 | 10/1972 | Aasen et al. | 271/64 |
| 4,469,319 | 9/1984 | Robb et al. | 271/3.1 |
| 4,480,824 | 11/1984 | Acquaviva | 271/171 X |
| 4,485,949 | 12/1984 | Gebhart et al. | 226/2 |
| 4,526,361 | 7/1985 | DuBois | 271/186 |
| 4,540,166 | 9/1985 | Massengeil | 271/171 X |

OTHER PUBLICATIONS

"Fanfold Paper Former" by J. H. Neer; *IBM Technical Disclosure Bulletin,* vol. 23, No. 11, Apr. 1981, p. 5260.

*Primary Examiner*—Richard A. Schacher

[57] ABSTRACT

A dual mode document feeder for feeding conventional document sheets from a stack thereof in the document feeding tray of the document feeder to the imaging station of a copier, the document feeding tray having a resettable side guide for those conventional document sheets, wherein the dual mode document feeder alternatively provides automatic restacking of fan-fold web documents in this same document tray. The document feeding tray is enlarged to accommodate the latter. The side guide is repositionable intermediately of the document feeding tray. The side guide has an additional integral fan-fold web end stopping surface intersecting with the tray bottom surface to provide restacking of fan-fold web thereon. Automatic fan-fold stacking of the fan-fold web document is provided in the document feeding tray by guiding the fan-fold web into the document feeding tray from the imaging station with the platen transport through a baffle guide to and against this additional side guide surface, in cooperation with the tray surfaces, for automatic restacking.

4 Claims, 2 Drawing Figures

DUAL-MODE COPIER DOCUMENT FEEDER AND COMPUTER FORMS WEB RESTACKER

Figure 1:
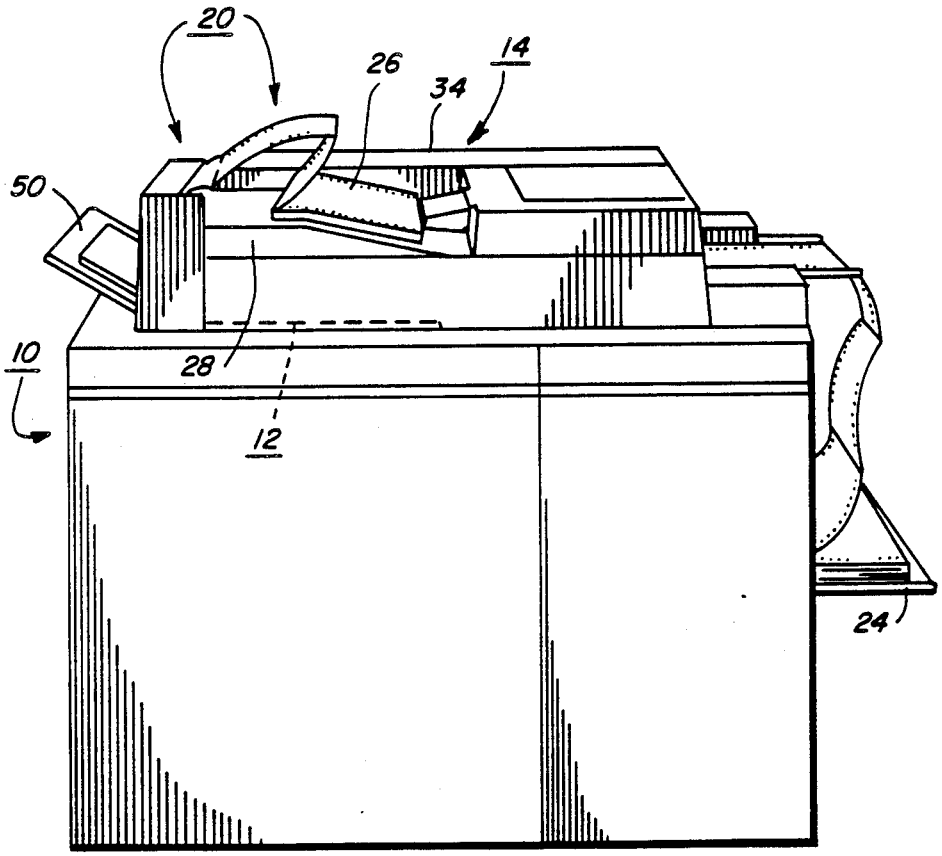

The present invention relates to a dual mode document handling apparatus for both feeding individual original document sheets for imaging on a copier from a tray and for alternatively providing a compact fan-fold web document restacker utilizing the same tray and common elements.

For xerographic and other copiers it has become increasingly important to provide more automatic handling of the original documents being copied, i.e. the input to the copier. It is desirable to automatically feed, register, copy, and restack document sheets of a variety or mixture of sizes, types, weights, materials, and conditions with minimal manual operator handling. Even with smaller and lower cost copiers, it has become increasingly desirable to provide at least semi-automatic document feeding, allowing an operator to initial load originals into an input of a document handler, with the document handler automatically providing the final deskewing, registration and feeding of the documents into and through the copying position, and then ejecting the documents automatically. However, for compact and low cost copiers, an appropriate document handler must also be simple, low cost and compact.

A preferable document handling system is one that overlies and utilizes an existing or generally conventional copier optical imaging system, utilizing the conventional external transparent copying window (known as the platen) of the copier. It is also desirable that the document handling system be readily pivotable away from the platen to alternatively allow the copier operator to conventionally manually place documents, including books, on the same copying platen. Thus, a light-weight document handler is desirable.

It is also desirable that the document handler and its document input and output (restacking) tray or trays be as compact as possible. In particular, it is desirable that these components not extend beyond or increase the overall maximum dimensions of the copier, if possible.

One type of original document presenting particular problems, because of its differences and general incompatibility with conventional document sheet handling, is computer form web, or "CF" or "fan-fold" as referred to herein. This is the well-known elongate web of odd-sized paper typically provided as the output of computer printers, etc. It comes in several different widths. Conventionally it has regular sprocket-feeding holes at ½ inch (12.7 mm) intervals along (closely adjacent) both edges. Normally it comes stacked, and is restacked, in zig-zag or "fan fold" form. Thus, CF web is also called "fan fold". The increased use of computers has increased the number of "CF" documents and the need for convenience copies thereof.

As used herein in relation to CF, a "segment" is the CF web segment, portion, frame or unseparated sheet. This is the area between the partial transverse slits, known as "perfs", provided at fan-folding crease lines for "bursting" the CF web into individual sheets, if desired. The present system desirably does not require such separation or bursting of a CF web for copying. The system herein feeds CF as a web from a fan-fold stack and automatically desirably restacks the CF web into a fan-fold stack after each selected portion thereof has been copied.

Disclosed herein is an exemplary CF web document feeder and restacker accessory system which is desirably integral an automatic document handling system or "ADH" for conventional (sheet) documents. However, this system may also be used with copiers having various other document handling systems, such as dual mode (RDH/SADH) types, and is compatible with either non-precollation or post-collation copying. U.S. Pat. No. 4,469,319 issued Sept. 4, 1984 to F. J. Robbe, et al, references cited therein, and other references cited herein, are noted for further background in these known technologies.

As previously noted, the feeding of an elongated web of computer fan-fold (CF) paper as a document to be copied on the platen of a copier presents special problems. Such paper is typically generated by a line-printer as the output of a computer. It is usually wider than most standard paper sizes, and conventionally has round "sprocket" holes at one-half inch (12.7 mm) intervals (center-to-center) extending along both edges. These holes are provided for sprocket or pin feeding the web. The web is typically folded in a zig-zag or "fan folded" stack of partially perforated but unburst portions. It is not desirable to burst or separate the CF web in many cases, yet in many cases it is desired to make registered individual sheet copies of segments of the CF web. Reduction copying of whole or partial segments or other selected portions of the CF web onto conventional paper size copy sheets is often desired.

Usually CF web is directly mechanically fed without any slippage with a sprocket wheel or a belt with pins (a "tractor" or "Kidder" drive) mating with the holes along both edges of the CF web. Numerous examples of such computer form feeders (CFF) are known in the art, and some are cited in the two patents cited below. However, there is a serious disadvantage in the use of such a pin or tractor feeder for a copier. Such a feeder cannot also feed conventional unperforated original document sheets. Nor can it be used for an over-platen transport. Thus separate document handler units, separately used, are conventional. However, there have now been provided a few document feeders for copiers using friction feeding for both CF web and conventional documents. Examples are disclosed in U.S. Pat. Nos. 4,485,949 issued Dec. 4, 1984 to S. A. Gebhart et al and 4,462,527 issued July 31, 1984 to T. N. Taylor et al, and indicated references cited therein.

The system herein allows the use of a conventional frictional platen transport, the same transport used for individual sheet documents. Appropriate such document platen transports for use with the document feeding and restacking system disclosed herein are disclosed in the above-cited and other references and in U.S. Ser. Nos. 678,859, '860, and '863, all filed Dec. 6, 1984.

Return transports with baffles for returning conventional individual document sheets from the platen back to an RDH restacking tray through a 180 degree path (with inverson) are known in the RDH art, e.g. the above-cited U.S. Pat. No. 4,469,319. Passive restacking baffles for restacking conventional document sheets on top of an SADH after copying are also known, e.g. U.S. Pat. No. 3,700,231 issued Oct. 24, 1972 to T. F. Aasen et al. Noted also is U.S. Pat. No. 4,526,361 issued July 2, 1985 to R. Clark Du Bois, and references cited.

IBM Technical Disclosure Bulletin, Vol. 23, No. 11, April 1981, p. 5260, by J. H. Neer, is noted for a CF restacker per se in which the downfold of the CF web is permitted to collapse down into the restacking end of the restacking tray and the CF upfold rolls out over the stack for restacking. However, conventional pin (sprocket) drive is provided for the uphill feeding of the CF web into this stacking tray.

Some examples of various other patents teaching conventional document handlers and also control systems therefor, including document path switches, are U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. Conventional simple software instructions in a copier's conventional microprocessor logic circuitry and software of document handler and copier control functions and logic, as taught by the above and other patents and various commercial copiers, are well known and preferred. However, it will be appreciated that the document handling functions and controls described herein may be alternatively conventionally incorporated into a copier utilizing any other suitable or known simple software or hard wired logic systems, switch controllers, etc. Such software for functions described herein may vary depending on the particular microprocessor or microcomputer system utilized, of course, but will be already available to or readily programmable by those skilled in the art without experimentation from the descriptions provided herein.

All references cited herein, and their references, are incorporated by reference herein for appropriate teachings of additional or alternative details, features, and/or technical background.

The present invention desirably overcomes or reduces various of the above-discussed problems.

A general disclosed feature herein is to provide a more compact and lower cost web document feeding accessory for various conventional copiers for feeding of a computer form or the like web document to a copier platen for copying and then restacking it into a fan-folded stack after copying which is fully compatible with feeding and restacking conventional sheet documents from the same feeder.

A specific feature disclosed herein is to provide a document feeder for feeding conventional document sheets from a stack thereof in a document feeding tray of the document feeder to the imaging station of a copier, and wherein said document feeding tray has a resettable side guide for the conventional document sheets, the improvement comprising a dual mode document feeder for alternatively fan-fold restacking a fan-fold web document in said same document tray, wherein said document feeding tray is enlarged to accommodate said fan-fold restacking of a fan-fold web document therein, and wherein said side guide is repositionable intermediately of said enlarged document feeding tray, and wherein said side guide has integral fan-fold web end stopping means thereon positioned in the path of a document being restacked in said tray when said side guide is so repositioned, for automatic engagement for fan-fold stacking of a fan-fold web document in said document feeding tray against said fan-fold web end stopping means when fan-fold web is fed into said document feeding tray from said imaging station.

Further features which may be provided by the apparatus disclosed herein, individually or in combinations, include those wherein said document feeding tray overlies said imaging station and said document feeder includes means for guiding a fan-fold web document from said imaging station into said document feeding tray over said restacking support means and into abutment with said fan-fold web end stopping means, which comprises a vertical end surface on the rear of said side guide.

Figure 2:
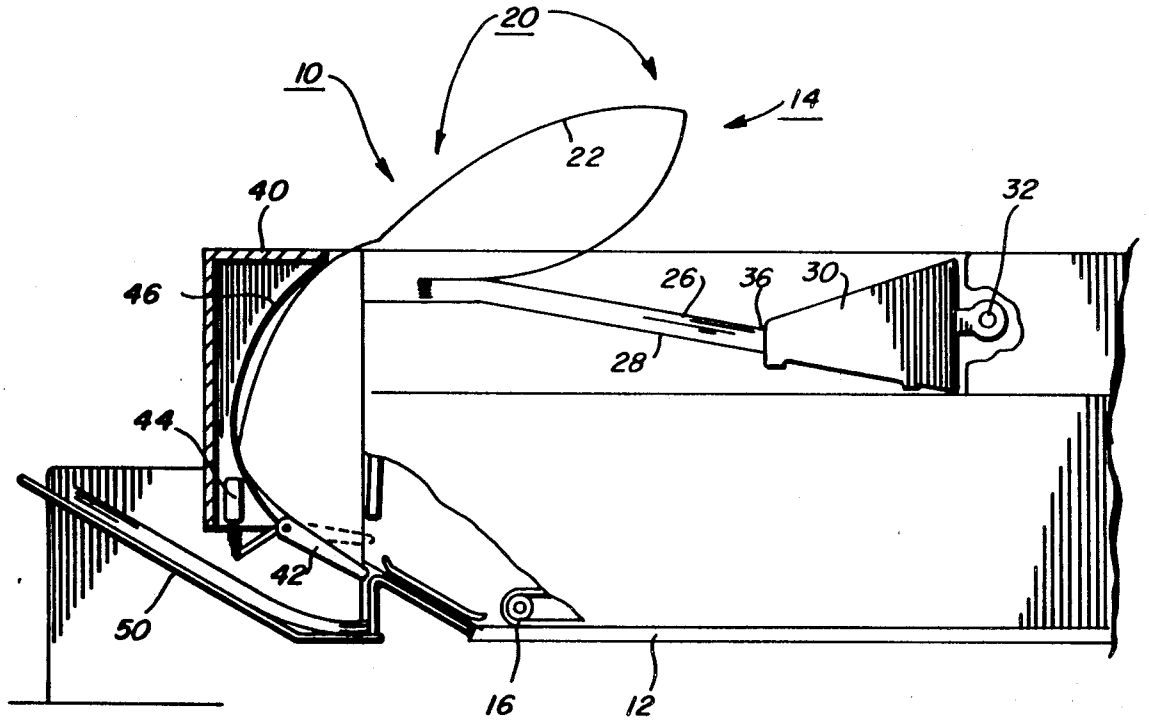

Various of the above-mentioned and further features and advantages will be apparent from the specific apparatus example and its operation described hereinbelow. The invention will be better understood by reference to this description of one embodiment thereof including the drawing figures (approximately to scale) wherein:

FIG. 1 is a perspective frontal view of one embodiment of an exemplary dual mode document handling apparatus on an exemplary copier, in accordance with the present invention, in its CF copying and restacking mode; and FIG. 2 is an enlarged partially cross-sectional front view of said dual mode document handling embodiment of FIG. 1.

FIGS. 1 and 2 partially illustrate a conventional modern copier 10 with its conventional platen imaging station 12 for imaging documents to be copied. Overlying this platen 12 is an exemplary automatic stack feeding document handler (ADH) 14 for sequentially presenting conventional individual sheet documents to the platen 12. These documents are transported by and imaged under a platen transport 16 which is part of the ADH 14, and comprises a belt or belts or wheels for frictional sheet driving. Various of the above-described references may be referred to for further details of these components. The disclosure here relates to a computer forms feeder accessory or modification kit 20 for feeding and restacking fan-fold web after it is copied at the same platen 12 and transported by the same transport 16. In this mode of operation the transport 16 is used for feeding a continuous form web document, such as the illustrated CF 22, from a fan-folded input stacking tray 24. The web 22 is unfolded and fed incrementally from tray 24 across the platen 12 by transport 16 for copying and then fed onto an output stack 26 wherein the web 22 is restacked back into its conventional zig-zag or fan-folded format, as shown in both FIGS. 1 and 2.

With conventional CF document feeders, even the few that are compatible with and utilize the document transport of a conventional document sheet ADH or RDH, the CF web must be restacked in a separate output stack in a separate tray therefor. Typically this is a wire basket tray or the like which must be separately attached to one end of the copier, adding to the overall external dimensions or "footprint" required by the copier. Particularly if this is in addition to a CF input tray at the opposite end of a copier, this disadvantageously requires a much larger operating area for the copier. That is particularly disadvantageous for the modern copiers which are otherwise much more compact and usable as convenience copiers in smaller locations near the work areas of the users. Furthermore, where the CF web document is restacked in a tray at the end of a copier it may require the operator to bend over to start the CF web folding properly, and to remove it, and to restack it if it does not fold properly. If the CF web does not refold properly, portions of it may feed out onto the floor and be damaged or contaminated.

With the system disclosed herein, as shown in both FIGS. 1 and 2, the computer forms web is restacked on top of the copier in the same tray 28 which alternatively serves as the sheet document input tray for the ADH 14. The ADH 14, and particularly the tray 28 and the side guide 30 for that tray, is specially configured and adapted for such dual mode or alternative functions, as will be described herein.

For the CF modification 20 of the ADH 14 here there is additionally provided a restacking unit 40 which simply attaches to the downstream end of the ADH 14 unit. This restacking unit 40 includes a decision gate 42 automatically appropriately actuated by a solenoid 44, and a passive return path guide or baffle 46. This gate 42 provides a low friction planer input surface leading into the baffle 46, at approximately 41 degrees below the horizontal. The baffle 46 has internal ribs providing a large radius path, and linear entrance and exit paths, which minimizes frictional resistance and the tendency for the web to fold or buckle in this arcuate path. Preferably this baffle path has a smaller radius in its initial portion than in its final or ejecting portion. Preferably the output of this baffle path is approximately 64 degrees above the horizontal so that the web is ejected in an upward direction as well as out over the tray. The entire restacking unit 40 is very compact, simple and low-cost. The entire baffle 46 and the mountings therein for the solenoid 44 and gate 42 can be a single simple plastic molding. It does not add either appreciable weight or appreciable increased length to the ADH 14. The baffle 46 turns the CF web 22 around a 180 degree turn and orients it for restacking on top of the ADH 14 in the tray 28 thereof as will be described further below.

It will be appreciated that if the document handler was an RDH instead that it would already contain a comparable document return or restacking path which could be used instead. That is, the restacking unit 40 would not be required for such a document feeder. However, a conventional RDH would not have a large enough input/restacking tray for CF web.

Except for the relatively minor modifications described herein, no other modification of the ADH 14 (or other ADH or RDH features which may be employed) is required to provide the compact and dual mode CF restacking/conventional document feeding integral system provided herein.

In the normal mode of operation of the ADH 14 the conventional document sheets are ejected by the platen transport 16 under the normally-raised gate 42 into a document sheet output tray 50 adjacent the downstream end of the platen 12, and at approximately the same level. When, however, the restacking unit 40 is attached to the ADH 14 and CF web copying is operator-selected on the copier controller console, this automatically actuates solenoid 44 to drop the gate 42 into the output path of any document fed from the platen by transport 16.

Thus, in CF operation, the downward position of the gate 42 automatically intercepts CF web and deflects it onto the contiguous large radius smooth inverting baffle surfaces provided in the baffle 46. The baffle 46 guides the CF web, without requiring any sprocket drive, or any other feeding means, out onto, over and above, the tray 28.

Turning now particularly to the modifications of the tray 28 and the tray side guide 30, these modifications add no cost to a conventional ADH input tray and do not impair in any way the conventional sheet feeding therefrom in the normal sheet feeding mode for the ADH. Yet they provide automatic fan-folded restacking of a wide range of different sizes of CF or other fan-folded web documents. A very simple and inexpensive modification of the conventional ADF tray, particularly the side guide 30, both stops the first CF web segment in the proper position in the tray and also insures proper fan-folding of the subsequent web segments. An effective tray bottom CF stack-holding configuration is provided in that position for insuring that the CF web folds reliably in the tray, by providing a concave restacking configuration for the CF output stack 26 in the tray 28.

For conventional sheet feeding, the inside vertical surface of the side guide 30 is conventionally set to abut or approximately abut one end of the stack of document sheets being fed out in the downstream end of the ADH 14. In this position, the side guide 30 will be slid out toward one side of the tray on its slide mounting 32 in the tray 28. This side guide 30 setting will depend on the length of the documents being fed, assuming they are conventionally fed widthwise by the ADH 14. Thus the side guide 30 may also be referred to as the ADF sheet length guide. The other document sheet side guide or end guide is provided here conventionally by a fixed vertical wall at the opposite side of the tray 28.

In the CF restacking mode of operation, the same side guide 30 performs a completely different function. There is a different, additional, surface 34 on the rear end of the side guide 30 extending substantially vertically from the tray surface, to form a CF stop 34 surface.

For the CF restacking mode, the slide mounting 32 is modified from the conventional side guide slide mounting to allow the side guide 30 to be slid into the intermediate or central area of the tray 28. That is, for the side guide 30 to be repositionable, for the CF mode, into a position approximately halfway between the open front of the tray 28 and the back wall thereof. However this repositioning is not critical. It is not necessary that the side guide 30 be repositioned under the exact mid-line of the CF output stack 26, because the stack 26 is supported by the bottom of the tray 28, which extends over the entire area of the tray 28 for complete stack support.

The tray 28 is substantially larger than a conventional sheet tray for a document feeder, so that even a large-segmented CF fan-fold can restack in the tray upstream of the end of the side guide 30. The tray 28 here is a dual-mode tray. It functions as an input tray for conventional cut sheets, but as an output tray for CF web.

As the leading edge of the first CF web segment is first fed into the tray 28 by the platen transport 16 with the gate 42 and baffle 46, it will fall into the tray 28 and be driven forward and then slide (uninterruptedly) up the surface 36, until it reaches the CF stop surface 34. This stops the forward movement of the CF web in the tray 28. The position of the CF stop 34 is adjacent the downstream end of the tray and is approximately slightly more than one CF web segment space from the desired opposite end of the CF stack position at the upstream end of the tray 28 for the largest size fold to be restacked. If the first fold line or crease in the CF web (at the burst line) is downwardly creased, the restacking of the CF web into its proper fan-fold stack will initiate automatically, without any required operator intervention, in most cases. If not, the only operator intervention required is to help fold over the second incoming web segment on top of the first to start a stack 26, if this does not occur automatically. This folding of the second web segment onto the stack 26 will be initiated as shown in FIG. 1, and continues as shown in FIG. 2, until the second web segment lies down on top of the first. The stack 26 cannot slide forward because of its abutment against the stop 34. Therefore, the rear edge, at the crease line, of the first CF web segment stops the forward movement of the leading edge of the second web segment and it automatically begins to roll over the first web segment as shown in FIG. 1, and continues to do so as it is fed in by the next web segment as shown in FIG. 2. This continues automatically for each web segment until the entire CF web 22 has been fed across the platen 12 by the platen transport 16 and fan-fold restacked as the CF output stack 26 in tray 28. If the tray bottom is concave, as shown, this can assist in fan-folding restacking.

As noted, the front of the CF output stack 26 rests against the CF stop 34. However, it is not necessary that the CF stop 34 extend up further than the height of the first few web segments in order to maintain the stacking position. Thus, the side guide 30 may be of otherwise normal dimensions, which are very small in comparison to the overall tray 28 dimensions. Note also the CF surface 34 does not affect or interfere with or require modification of the conventional side or end guide surface of the side guide 30. Thus the normal function of side guide 30 is not impared at all, and it may be of approximately normal size and cost, yet now provide a valuable new function.

While the embodiment disclosed herein is preferred, it will be appreciated that, from this teaching, various alternatives, modifications, variations or improvements thereon may be made by those skilled in the art, which are intended to be encompassed by the following claims:

What is claimed is:

1. In a document feeder for feeding conventional document sheets from a stack thereof in a document feeding tray of the document feeder to the imaging station of a copier, and wherein said document feeding tray has a resettable side guide for the conventional document sheets, the improvement comprising a dual mode document feeder for alternatively fan-fold restacking a fan-fold web document in said same document tray, wherein said document feeding tray is enlarged to accommodate said fan-fold restacking of a fan-fold web document therein, and wherein said side guide is repositionable intermediately of said enlarged document feeding tray, and wherein said side guide has integral fan-fold web end stopping means thereon positioned in the path of a document being restacked in said tray when said side guide is so repositioned, for automatic engagement for fan-fold stacking of a fan-fold web document in said document feeding tray against said fan-fold web end stopping means when fan-fold web is fed into said document feeding tray from said imaging station.

2. The dual mode document feeder of claim 1 wherein said document feeding tray overlies said imaging station and said document feeder includes means for guiding a fan-fold web document from said imaging station into said document feeding tray into abutment with said fan-fold web end stopping means.

3. The dual mode document feeder of claim 1 wherein said fan-fold web end stopping means is defined by a substantially vertical end surface on said side guide.

4. The dual mode document feeder of claim 2 wherein said fan-fold web end stopping means is defined by a substantially vertical end surface on said side guide.

* * * * *